US007574013B2

(12) United States Patent
Funahashi et al.

(10) Patent No.: US 7,574,013 B2
(45) Date of Patent: Aug. 11, 2009

(54) SPEAKER

(75) Inventors: Osamu Funahashi, Osaka (JP); Seiichi Yoshida, Osaka (JP); Kimihiro Ando, Mie (JP); Kazuyoshi Umemura, Mie (JP); Yoichi Asahi, Aichi (JP)

(73) Assignee: Panasonic Corporation, Osaka (JP)

( * ) Notice: Subject to any disclaimer, the term of this patent is extended or adjusted under 35 U.S.C. 154(b) by 271 days.

(21) Appl. No.: 10/585,942

(22) PCT Filed: Dec. 9, 2005

(86) PCT No.: PCT/JP2005/022641

§ 371 (c)(1),
(2), (4) Date: Jul. 13, 2006

(87) PCT Pub. No.: WO2006/064725

PCT Pub. Date: Jun. 22, 2006

(65) Prior Publication Data

US 2007/0121995 A1 May 31, 2007

(30) Foreign Application Priority Data

Dec. 14, 2004 (JP) ..... 2004-361167

(51) Int. Cl.
*H04R 25/00* (2006.01)

(52) U.S. Cl. ..... 381/397; 381/433; 381/396

(58) Field of Classification Search ..... 381/433, 381/386, 419, 412, 334, 395–397
See application file for complete search history.

(56) References Cited

U.S. PATENT DOCUMENTS 4,547,632 A * 10/1985 Bryson ..... 381/189
4,580,015 A * 4/1986 O'Neill ..... 381/396
5,583,945 A * 12/1996 Iijima et al. ..... 381/412
5,594,805 A * 1/1997 Sakamoto et al. ..... 381/412
5,940,522 A * 8/1999 Cahill et al. ..... 381/397
6,243,479 B1 * 6/2001 Proni ..... 381/420
6,289,106 B1 * 9/2001 Wong ..... 381/405
6,529,107 B2 * 3/2003 Shimizu et al. ..... 335/302

(Continued)

FOREIGN PATENT DOCUMENTS

JP 33-514 1/1958

(Continued)

OTHER PUBLICATIONS

Supplementary European search report issued May 7, 2009 in connection with corresponding European Application No. 05 81 4753.

*Primary Examiner*—Curtis Kuntz
*Assistant Examiner*—Ryan C Robinson
(74) *Attorney, Agent, or Firm*—Wenderoth, Lind & Ponack, L.L.P.

(57) ABSTRACT

The speaker has a frame, a magnetic circuit, a voice coil body and a diaphragm. The magnetic circuit is disposed inside of the frame to form a magnetic gap. The voice coil body is disposed movably in the magnetic gap. The diaphragm is coupled to the voice coil body by an inner periphery edge thereof and to the frame by an outer periphery edge thereof. The outer peripheral surface of a convex portion provided on a bottom of the frame is at least either being brought into contact with or in proximity to the magnetic circuit. The configuration can provide the speaker with excellent heat dissipation characteristics.

12 Claims, 4 Drawing Sheets

U.S. PATENT DOCUMENTS

| | | | | |
|---|---|---|---|---|
| 6,665,414 | B1 * | 12/2003 | Murayama et al. | 381/397 |
| 7,012,345 | B2 * | 3/2006 | Moro et al. | 310/12 |
| 2003/0185415 | A1 * | 10/2003 | Funahashi et al. | 381/398 |
| 2004/0195039 | A1 | 10/2004 | Sahyoun | |
| 2005/0201588 | A1 | 9/2005 | Funahashi et al. | |

FOREIGN PATENT DOCUMENTS

| | | | |
|---|---|---|---|
| JP | 58-66794 | | 5/1983 |
| JP | 58-48871 | | 11/1983 |
| JP | 61-37692 | | 3/1986 |
| JP | 61-104698 | | 7/1986 |
| JP | 5-18198 | | 3/1993 |
| JP | 06-006895 | * | 1/1994 |
| JP | 06006895 A | * | 1/1994 |
| JP | 8-47072 | | 2/1996 |
| JP | 9-215090 | | 8/1997 |
| JP | 2004-304512 | | 10/2004 |
| JP | 2004-350317 | | 12/2004 |

* cited by examiner

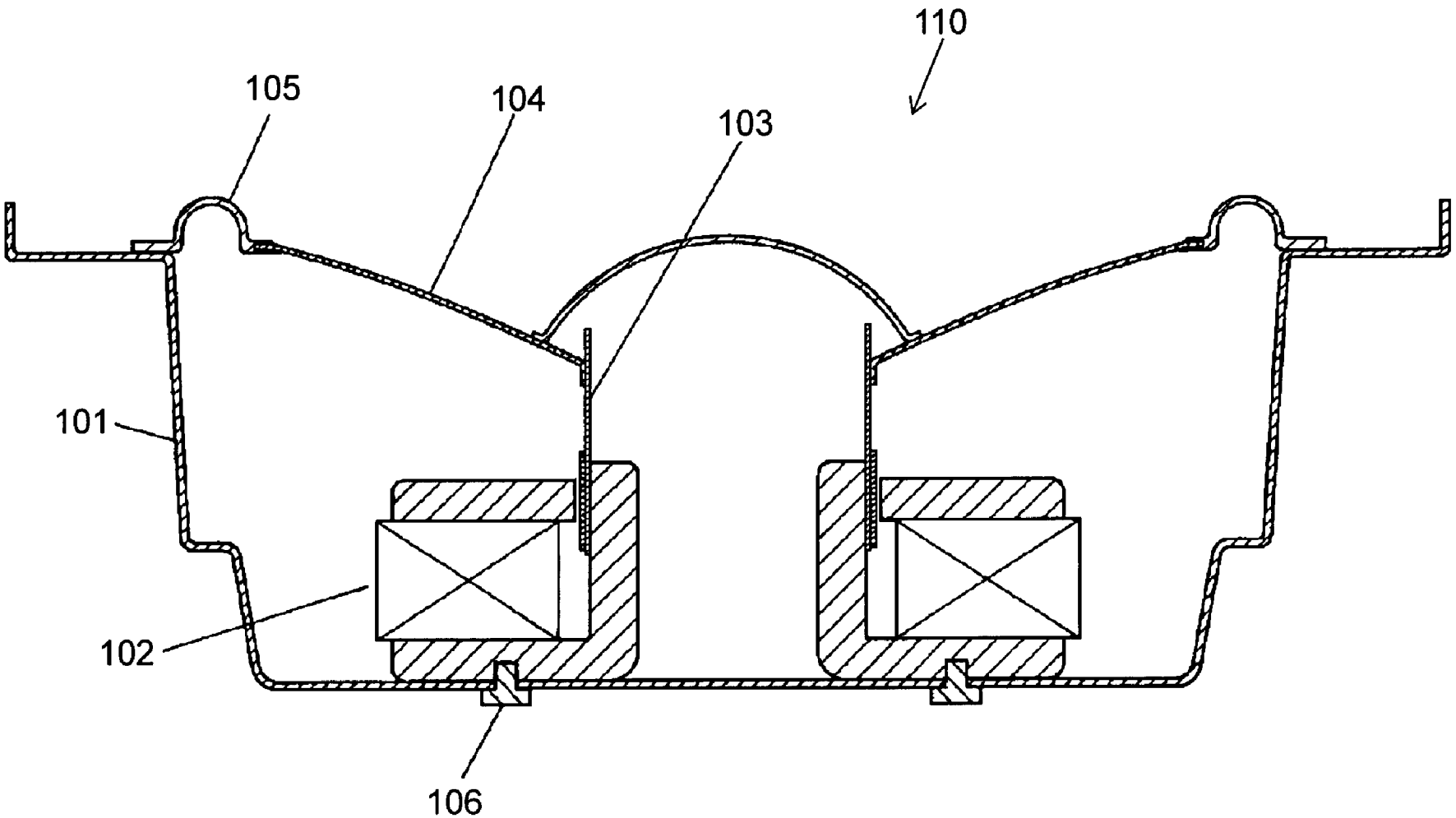
FIG. 4 – PRIOR ART

SPEAKER

This application is a U.S. national phase application of PCT International Application PCT/JP2005/022641, filed Dec. 9, 2005.

1. Technical Field

The present invention relates to a speaker for use in various kinds of audio and video equipments.

2. Background Art

As shown in FIG. 4, a conventional speaker 110 has magnetic circuit 102 provided on the bottom surface of frame 101. Voice coil body 103 is disposed movably to magnetic circuit 102. An inner periphery edge of diaphragm 104 is coupled to voice coil body 103. An outer periphery edge of diaphragm 104 is coupled to frame 101 via edge portion 105. When speaker 110 is driven, magnetic circuit 102 generates heat. The heat generated by magnetic circuit 102 is transferred to frame 101 acting as a heat sink.

Magnetic circuit 102 is fixed by bonding it on a flat portion in the bottom surface of frame 101. Consequently, the heat generated by magnetic circuit 102 is transferred to frame 101 through the bottom surface of magnetic circuit 102 that comes into contact with frame 101.

Screw 106 strengthens the coupling of magnetic circuit 102 with frame 101 to prevent magnetic circuit 102 from displacing.

Such conventional speaker 110 is disclosed for instance in Japanese Utility Model Unexamined Publication No. H5-18198.

As is common with an on-vehicle speaker, a high power speaker is becoming more popular recently. Along with the trend, magnetic circuit 102 is required to have improved heat dissipation characteristics. However, it is difficult for the structure of conventional magnetic circuit 102 to have sufficient heat dissipation characteristics.

SUMMARY OF THE INVENTION

A speaker of the present invention has a frame, a magnetic circuit, a voice coil body and a diaphragm. The magnetic circuit is disposed inside of the frame to form a magnetic gap. The voice coil body is disposed movably in the magnetic gap. The diaphragm is coupled to the voice coil body by an inner periphery edge thereof and to the frame by an outer periphery edge thereof. An outer peripheral surface of a convex portion provided on a bottom of the frame is at least either being brought into contact with or in proximity to the magnetic circuit. The configuration can provide the speaker with excellent heat dissipation characteristics.

BRIEF DESCRIPTION OF THE DRAWINGS

FIG. 4 shows a cross sectional view of a conventional speaker.

REFERENCE MARKS IN THE DRAWINGS

Figure 1:
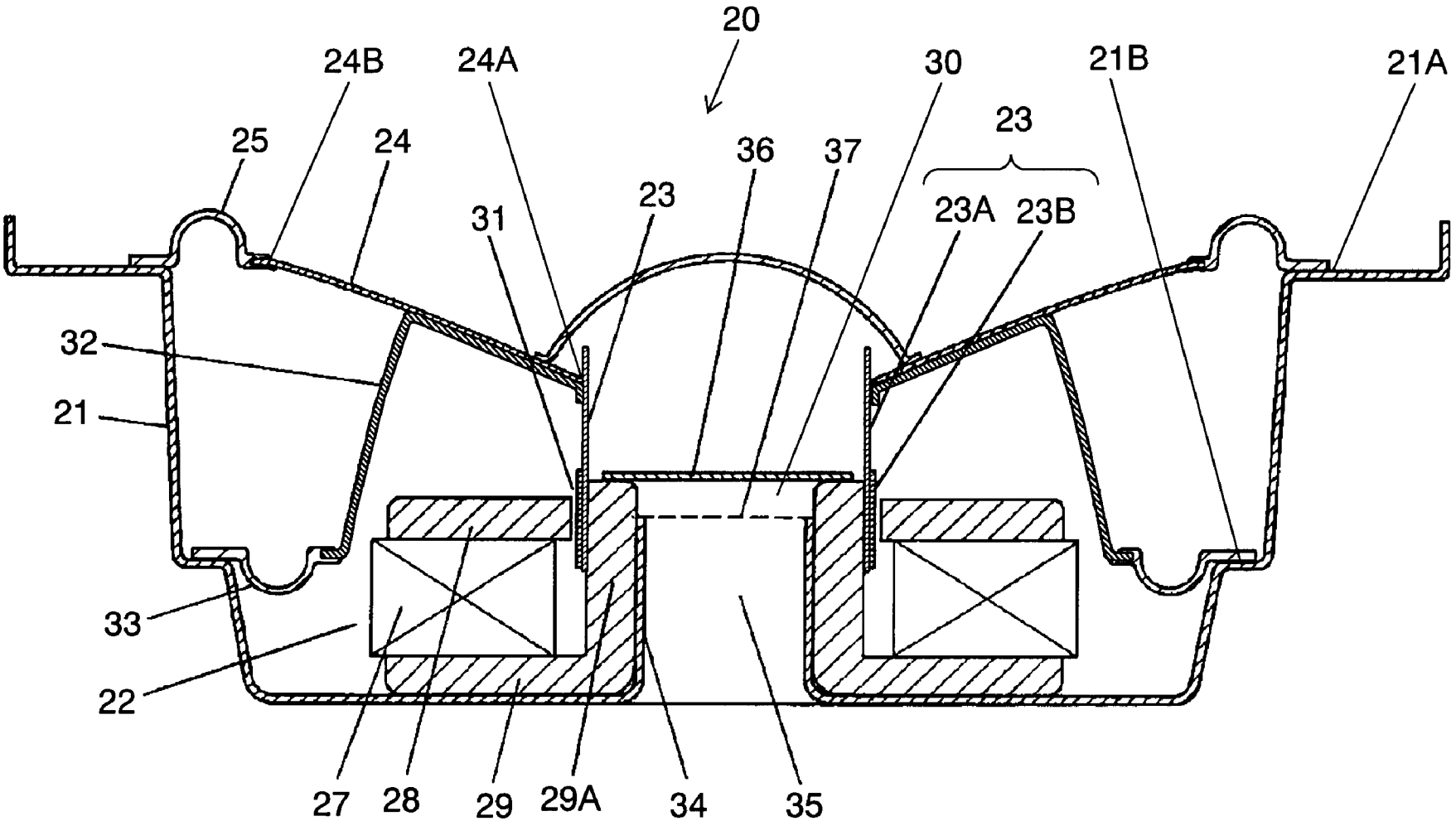
FIG. 1 shows a cross sectional view of a speaker in an exemplary embodiment of the present invention.

20, 20B speaker
21 frame
21A opening edge
21B bottom portion
22, 22B magnetic circuit
23 voice coil body
23A main body
23B voice coil
24 diaphragm
24A inner periphery edge
24B outer periphery edge
25 first edge portion
27, 27B magnet
28 plate
29 yoke
29A side-wall portion
30 through-hole
31 magnetic gap
32 suspension holder
33 second edge portion
34 convex portion
35 through-hole
36 dust-proof net
36A edge
41 gap
110 speaker
101 frame
102 magnetic circuit
103 voice coil body
104 diaphragm
105 edge portion

DETAILED DESCRIPTION OF THE PREFERRED EMBODIMENTS

Figure 2:
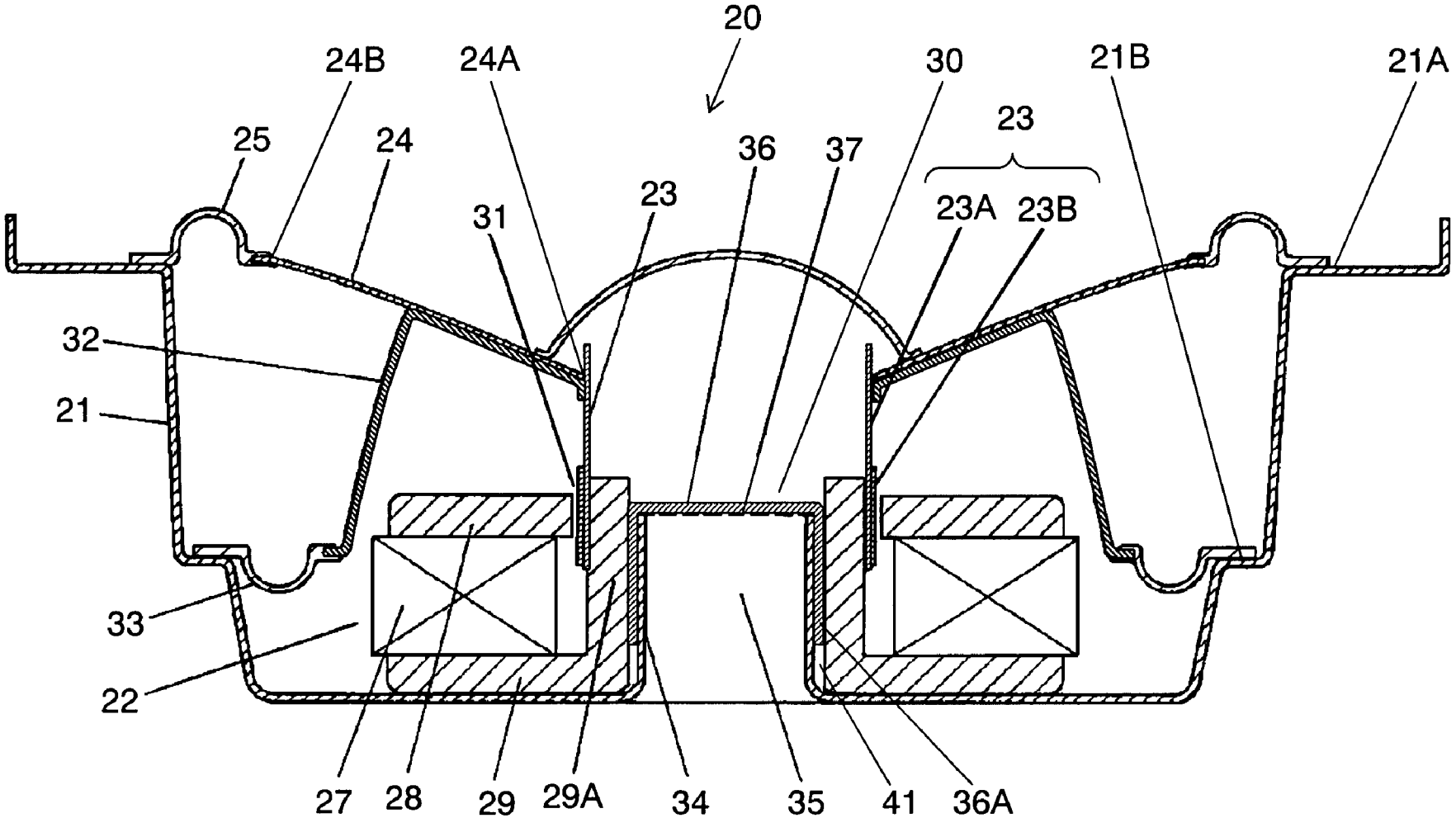
FIG. 2 shows a cross sectional view of a speaker in another exemplary embodiment.

Now, the preferred embodiments of the present invention are described with reference to drawings. FIG. 1 shows a cross-sectional view of the speaker of the present invention. FIG. 2 shows a cross-sectional view of the speaker used in another embodiment of the present invention. In FIGS. 1 and 2, frame 21 made of an iron plate has magnetic circuit 22 disposed on a bottom center of frame 21. Magnetic circuit 22 includes magnet 27, plate 28 and yoke 29 which are combined and bonded together. Yoke 29 has cylindrical side-wall portion 29A with through-hole 30. Magnetic gap 31 is formed between side-wall portion 29A and an end face of inner periphery of plate 28. Magnetic gap 31 is formed having an opening upward over magnetic circuit 22.

Voice coil body 23 has a structure including cylindrical main body 23A and voice coil body 23B wound on an outer peripheral of main body 23A. Voice coil body 23 is disposed movably in magnetic gap 31 and is driven by magnetic circuit 22.

Inner periphery edge 24A of diaphragm 24 is coupled to an upper portion of outer periphery of voice coil body 23. Diaphragm 24 vibrates when voice coil body 23 is driven. Outer periphery edge 24B of diaphragm 24 is coupled to opening edge 21A of frame 21 via first edge portion 25 (hereafter referred to as edge 25). A back side of diaphragm 24 is coupled to bottom portion 21 B of frame 21 via suspension holder 32 and second edge portion 33 (hereafter referred to as edge 33). A power point for driving voice coil body 23 is disposed inside of an area surrounded by edges 25 and 33 coupled to frame 21 respectively. The configuration can restrain voice coil body 23 from rolling phenomena since diaphragm 24, suspension holder 32 and voice coil body 23 all together form a structure to act as a rigid body. At the same time, the configuration in which diaphragm 24 can move freely enables speaker 20 to attenuate harmonic components.

Speaker 20 is provided with cylindrical convex portion 34 protruding inward from the bottom surface of frame 21. Sidewall portion 29A comes into contact with an outer peripheral surface of convex portion 34 as shown in FIG. 1. Consequently, a heat generated by magnetic circuit 22 is dissipated to frame 21 not only through the bottom surface of magnetic circuit 22 as performed in the conventional speaker, but also through side-wall portion 29A of magnetic circuit 22. Since frame 21 functions to act as a heat sink, the configuration dissipates the heat from magnetic circuit 22 effectively, improving the heat dissipation characteristics of magnetic circuit 22. The improved heat dissipation characteristics of magnetic circuit 22 can realize an increase in the maximum input power to speaker 20.

Magnetic circuit 22 includes magnet 27, plate 28 and yoke 29. Electric signals are applied to voice coil body 23B placed in magnetic gap 31 formed by magnetic circuit 22. This drives voice coil body 23 to move vertically, causing side-wall portion 29A of yoke 29 facing voice coil body 23B to become a heat source eventually. Among components of speaker 20, side-wall portion 29A generates the maximum amount of heat. Since side-wall portion 29A comes into contact with convex portion 34 coupled to frame 21 thermally as well, the heat dissipation efficiency from magnetic circuit 22 to frame 21 can be improved specifically. The heat dissipation of magnetic circuit 22, therefore, will be increased very effectively.

Since convex portion 34 is formed along on an inner peripheral surface of side-wall portion 29A, convex portion 34 determines the positioning of magnetic circuit 22. That is, the form is to insert convex portion 34 into through-hole 30 of magnetic circuit 22. Therefore, a structure such as screwing magnetic circuit 22 on frame 21 that has been carried out conventionally to prevent displacement is not necessary any more. This can realize a decrease in manufacturing processes of speaker 20, improving the productivity of speaker 20 consequently.

As to forming convex portion 34, a columnar or cylindrical convex portion composed of a different heat conductive material may be acceptable to mount on the bottom surface of frame 21. However, convex portion 34 is formed by press working or the like on the bottom surface of frame 21 by utilizing a portion of frame 21 as shown in FIG. 1. That is, convex portion 34 is formed so as to protrude inward by bending the bottom portion of frame 21. This is an integrated structure including frame 21 and convex portion 34 with no coupling causing no decrease in thermal conductivity in the coupling. The heat from magnetic circuit 22 is transferred to frame 21 efficiently without any loss in thermal conduction consequently.

To improve the heat dissipation characteristics of frame 21, the surface area of frame 21 should only be kept large. Though not shown here particularly, irregularities (not shown) provided on the surface of frame 21 would also be effective. If the irregularities are provided with a beamed pattern, the beamed pattern would also function to strengthen frame 21. The configuration, therefore, can improve not only the heat dissipation characteristics but the mechanical strength of speaker 20.

Convex portion 34 formed by bending a part of frame 21 upward makes through-hole 35 in the bottom of frame 21. Dust-proof net 36 is provided on a top opening face of magnetic circuit 22 in speaker 20. The top face of magnet circuit 22 is placed over a top end of through-hole 35. This prevents dusts from entering into magnetic gap 4-4-31 via through-hole 35. At the same time, dust- proof net 36 has a structure capable of setting easily.

Dust-proof net 36 is disposed on a position so as to cover the top end of convex portion 34. The position disposing dust-proof net 36 is shown by broken line 37.

Moreover, a part of dust-proof net 36 composed of a flexible member may be inserted into the gap between convex portion 34 and side-wall portion 29A, as shown in FIG. 2. The structure allows the outer peripheral surface of convex portion 34 to come into contact with side-wall portion 29A via edge 36A of dust-proof net 36. This can improve the positioning accuracy of magnetic circuit 22 to frame 21.

That is, the form is to insert convex portion 34 into through-hole 30 of magnetic circuit 22. Taking the insertion workability into consideration, through-hole 30 is usually formed to have a little larger inner diameter than the outer diameter of convex portion 34. This creates gap 41 that is the difference between the inner diameter of through-hole 30 and the outer diameter of convex portion 34. Side-wall portion 29A composing magnetic circuit 22 is disposed in proximity to the outer peripheral surface of convex portion 34 via gap 41. Namely, magnetic circuit 22 is disposed in proximity to the outer peripheral surface of convex portion 34, forming a clearance of gap 41.

Forming of gap 41, however, causes a decrease in the positioning accuracy of magnetic circuit 22 to frame 21. So, the decrease in positioning accuracy of magnetic circuit 22 to frame 21 is restrained by inserting edge 36A of dust-proof net 36 into gap 41 as an intermediate.

The outer peripheral surface of convex portion 34 comes into contact with side-wall portion 29A via edge 36A composed of the flexible member. This means that side-wall portion 29A is coupled with frame 21 thermally via dust-proof net 36. The heat generated in side-wall portion 29A, therefore, is transferred to frame 21 through dust-proof net 36 and the heat is dissipated out of frame 21. The heat dissipation characteristics of magnetic circuit 22 are improved consequently.

When convex portion 34 is inserted into through-hole 30, dust-proof net 36 is sandwiched in the clearance between convex portion 34 and side-wall portion 29A. Dust-proof net 36 should, therefore, preferably be formed from the flexible member, taking easiness of insertion, curling and surrounding, and thermal conductivity into account. Material having lower hardness than that for convex portion 34 or side-wall portion 29A should preferably be used for the flexible member. For example, resins such as a rubber or metals with lower hardness among various metals can be used as the flexible member. Additionally, materials having higher heat conductivity than that for convex portion 34 or side-wall portion 29A should preferably be used for the flexible member. Particularly, by using a metal having high heat conductivity among low hardness metals such as for instance aluminum for the flexible member, the heat dissipation characteristics can be improved further.

Speaker 20 has such a structure that the back surface of diaphragm 24 is held on frame 21 by suspension holder 32. Suspension holder 32 has also an effect to improve sound reproducing characteristics. Installing suspension holder 32, however, narrows airspace around magnetic circuit 22. This situation is more likely to trap the heat inside of speaker 20. The aforesaid improvement in the heat dissipation characteristics will work on speaker 20 with suspension holder 32 further effectively.

Figure 3:
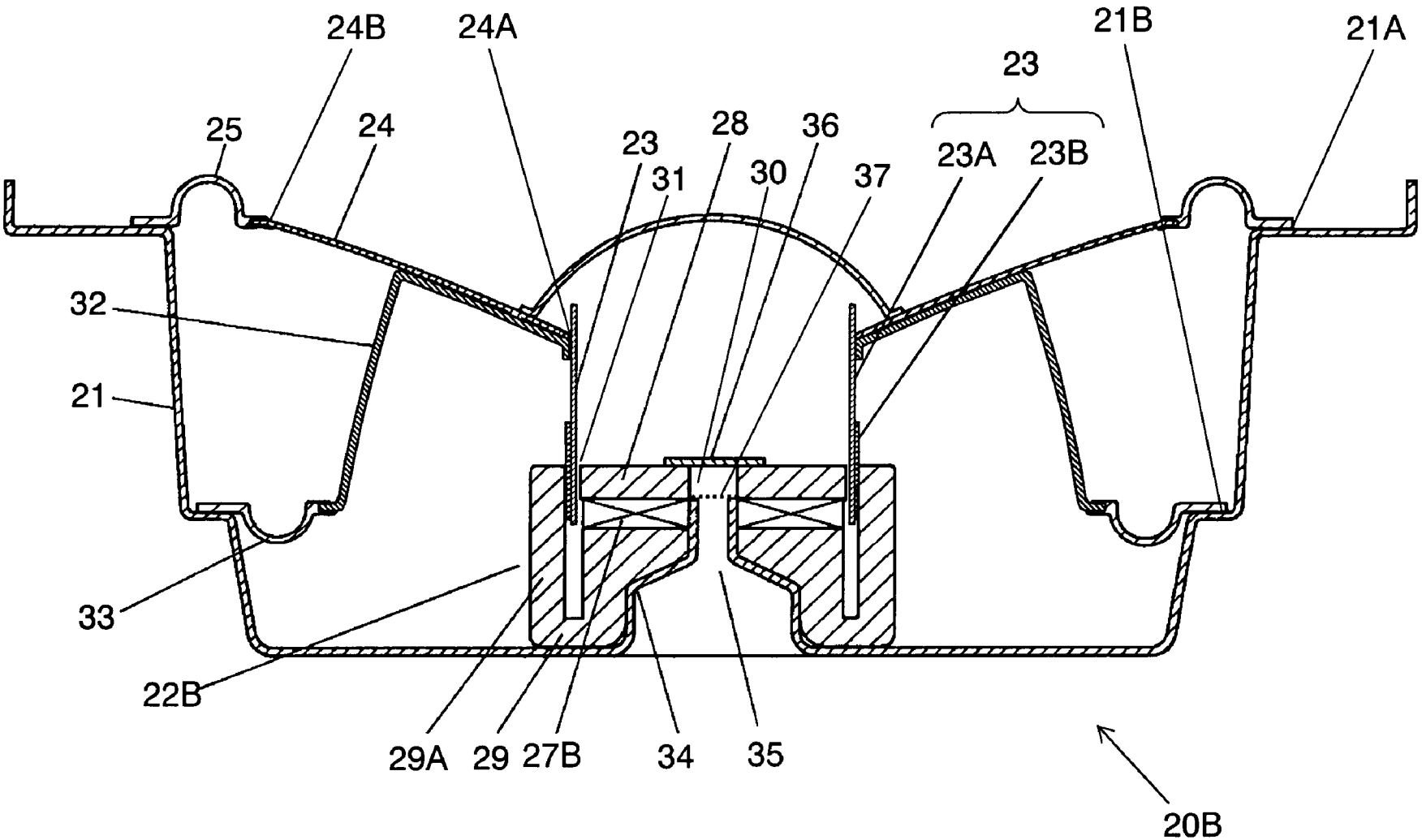
FIG. 3 shows a cross sectional view of a speaker in still another exemplary embodiment.

In the aforesaid embodiment, magnetic circuit 22 is described as having, for examples a so-called external magnet type in which magnet 27 and plate 28 are disposed outside of side-wall portion 29A using side-wall portion 29A to act as a central axis. However, magnetic circuit 22B having a so-called internal magnet type can also perform similar effects in which magnet 27B and plate 28 are disposed inside of sidewall portion 29A by using side-wall portion 29A provided on an outer periphery of yoke 29 to act as an outside guide as shown in FIG. 3.

Magnet 27B provided for magnetic circuit 22B having an internal magnet type is inevitably smaller than that of magnetic circuit 22 having an external magnet type. To account for the decrease in magnetic intensity, neodymium, which is a ferromagnetic material, is chosen as a material for magnet 27B. Neodymium, however, has a physical property of demagnetization in high temperature. The physical property of demagnetization means a decreasing magnetic force. Therefore, when Neodymium is used for the internal magnet type magnetic circuit 22B is necessary to effectively dissipate the heat generated from magnet 27B that faces voice coil body 23 Speaker 20B has a configuration in which magnet 27B and its vicinity are brought into contact with or in proximity to convex portion 34. Therefore, the configuration of speaker 20B allows the magnetic circuit 22B to dissipate heat particularly effectively.

In the aforesaid configuration, diaphragm 24 is coupled to frame 21 via edge 25, and suspension holder 32 is coupled to frame 21 via edge 33. The present invention, however, is not limited only to the configuration having edges 25 and 33. Another configuration having diaphragm 24 coupled to frame 21 directly or suspension holder 32 coupled to frame 21 directly may also be acceptable.

INDUSTRIAL APPLICABILITY

The speaker disclosed in this invention performs well when harmonic distortion must be lowered and is particularly useful for high power speaker such as for an on-vehicle use or the like.

The invention claimed is:

1. A speaker, comprising:

a frame including a frame bottom and a convex portion extending upwardly from said frame bottom, said convex portion being open at a top end to form a through-hole in said frame;

a magnetic circuit having a magnetic gap, said magnetic circuit being disposed inside of said frame;

a voice coil body disposed movably in said magnetic gap; and a diaphragm having an inner periphery edge and an outer periphery edge, said inner periphery edge being coupled to said voice coil body and said outer periphery edge being coupled to said frame, wherein said magnetic circuit includes a magnet and a yoke supporting said magnet, said yoke having a sidewall portion and a flange portion extending radially outward from said sidewall portion, said sidewall portion of said yoke contacting said convex portion of said frame and said flange portion of said yoke contacting said frame bottom of said frame so as to dissipate heat from said magnetic circuit to said frame.

2. The speaker of claim 1, wherein said convex portion is constituted by a bent bottom part of said frame.

3. The speaker of claim 1, further comprising:

a dust-proof net covering said through-hole in said frame.

4. The speaker of claim 3, wherein said dust-proof net is formed of a flexible member.

5. The speaker of claim 4, wherein said flexible member is formed of a metal having a low hardness.

6. The speaker of claim 4, wherein said flexible member is formed of a metal having a high thermal conductivity.

7. The speaker of claim 4, wherein said flexible member is formed of aluminum.

8. The speaker of claim 1, wherein said magnetic circuit has a circuit through-hole, and the speaker further comprises a dust-proof net disposed so as to cover a top end of said circuit through-hole.

9. The speaker of claim 1, further comprising:

a suspension-holder having one end coupled to said frame and another end coupled to a back surface of said diaphragm.

10. The speaker of claim 1, wherein said sidewall portion is cylindrical.

11. The speaker of claim 1, wherein said convex portion is in contact with said magnetic circuit at a junction formed between said sidewall portion and said flange portion.

12. The speaker of claim 1, wherein said frame comprises an outer wall disposed radially outwardly of said convex portion and extending upwardly from said frame bottom to a frame top supporting said diaphragm, and wherein said outer wall, said frame bottom, and said convex portion are integrally formed so as to maximize heat dissipation from said magnetic circuit to said frame.

* * * * *